US006375517B1

(12) United States Patent
Okabe et al.

(10) Patent No.: US 6,375,517 B1
(45) Date of Patent: Apr. 23, 2002

(54) JOINING CONNECTOR SYSTEM

(75) Inventors: Toshiaki Okabe; Tetsuya Yamashita, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/628,307

(22) Filed: Jul. 28, 2000

(30) Foreign Application Priority Data

Jul. 30, 1999 (JP) ..... 11-217454

(51) Int. Cl.[7] ..... H01R 13/502; H01R 13/514; H01R 13/40; H01R 9/22

(52) U.S. Cl. ..... 439/701; 439/594; 439/717

(58) Field of Search ..... 439/701, 594, 439/717

(56) References Cited

U.S. PATENT DOCUMENTS 4,425,018 A * 1/1984 Stenz ..... 439/716
5,895,296 A * 4/1999 Okabe ..... 439/701
5,904,598 A * 5/1999 Yamanashi ..... 439/701
5,938,481 A * 8/1999 Okabe et al. ..... 439/748
5,984,732 A * 11/1999 Mehring ..... 439/701

FOREIGN PATENT DOCUMENTS

JP 62-15774 1/1987
JP 11-312547 11/1999

* cited by examiner

*Primary Examiner*—P. Austin Bradley
*Assistant Examiner*—Edwin A. León
(74) *Attorney, Agent, or Firm*—Finnegan, Henderson, Farabow, Garrett & Dunner, L.L.P.

(57) ABSTRACT

A joining connector system comprises: one connector having an engaging piece protruded on a connector housing thereof; and another connector having an engaging groove to which the engaging piece fits and which is formed in a connector housing thereof, the joining connector system being joined by sliding the engaging groove and the engaging piece with each other in a sliding direction. In such a structure, a protrusion having a shape tapered toward the sliding direction is provided near an end portion in a side in which a join of the joining connector is finished in the sliding direction, in at least one of the engaging piece and the engaging groove.

9 Claims, 4 Drawing Sheets

JOINING CONNECTOR SYSTEM

BACKGROUND OF THE INVENTION

The present invention relates to a joining connector system formed in a pair by joining a plurality of connectors, and more particularly to a joining connector system intending to improve an assembly property by reducing an inserting force for combining the connectors.

Conventionally, in order to improve a handling property of a plurality of connectors, there is employed a joining connector system for joining connectors to each other.

Japanese Unexamined Patent Laid-open Publication No. 62-15774 discloses a connector structure employing an engaging projection and an engaging groove.

SUMMARY OF THE INVENTION

In accordance with a consideration of the inventors of the present application, as shown in FIGS. 4 and 5, a plurality of terminal receiving chambers 6 and 7 are formed in connector housings 4 and 5 of two connectors 2 and 3 joined to each other in the joining connector system 1. Electric wires 10 and 11 from wire harnesses 8 and 9 are drawn into the terminal receiving chambers 6 and 7 in the respective connectors, and connected to terminals (not shown) within the terminal receiving chambers 6 and 7.

These connectors 2 and 3 are joined to each other by relatively sliding the connector housings 4 and 5 in a direction of an arrow D.

In order to perform the join mentioned above, a fitting groove 12 is formed on an outer wall in one side of the connector housing 4 of the connector 2, and a T-shaped fitting projection 13 fitting to an engaging groove 12 is formed on an outer wall of the connector housing 5 of the connector 3 corresponding to the fitting groove 12.

These fitting groove 12 and the fitting projection 13 extend along a fitting direction of the connector housings 4 and 5, and can join both of the connectors 2 and 3 as shown in FIG. 5 by fitting the fitting projection 13 to the fitting groove 12 and sliding them.

However, in the joining connector system 1 having the structure mentioned above, a gap 14 is generated between the fitting groove 12 and the fitting projection 13 as shown in FIG. 6 due to a heat contraction generated at a time of injection molding the connector housings 4 and 5 and the other reasons, a play in directions shown by arrows 16 and 17 is generated due to the gap 14, and the connector housings 4 and 5 generate a relative positional shift due to the play as shown by a broken line.

Since the connector housings 4 and 5 are shifted from a regular position so as to generate a so-called pitch shift when the play mentioned above is generated, the joining connector system 1 is interfered with an opposing connector (not shown) at a time of fitting the joining connector system 1 to the opposing connector and becomes shaky so as to be hard to be fitted. In addition, there is a case that the terminals within the terminal receiving chambers 6 and 7 can not be in contact with the terminals in the opposing connector in a good state.

Accordingly, an object of the present invention is to provide a joining connector system which intends to improve an assembly property by reducing an inserting force for combining connectors and reducing a play generated between joined connector housings so as to effectively prevent a pitch shift from generating.

In accordance with the present invention, there is provided a joining connector system comprises: one connector having an engaging piece protruded on a connector housing thereof; and another connector having an engaging groove to which the engaging piece fits and which is formed in a connector housing thereof, the joining connector system being joined by sliding the engaging groove and the engaging piece with each other in a sliding direction. Further, in such a structure, a protrusion having a shape tapered toward the sliding direction is provided near an end portion in a side in which a join of the joining connector is finished in the sliding direction, in at least one of the engaging piece and the engaging groove.

DETAILED DESCRIPTION OF THE PREFERRED EMBODIMENT

A description will be in detail given below of an embodiment of a joining connector system in accordance with the present invention with reference to the accompanying drawings.

At first, a description will be given below of a structure of a joining connector system C in accordance with the present embodiment.

Figure 1:
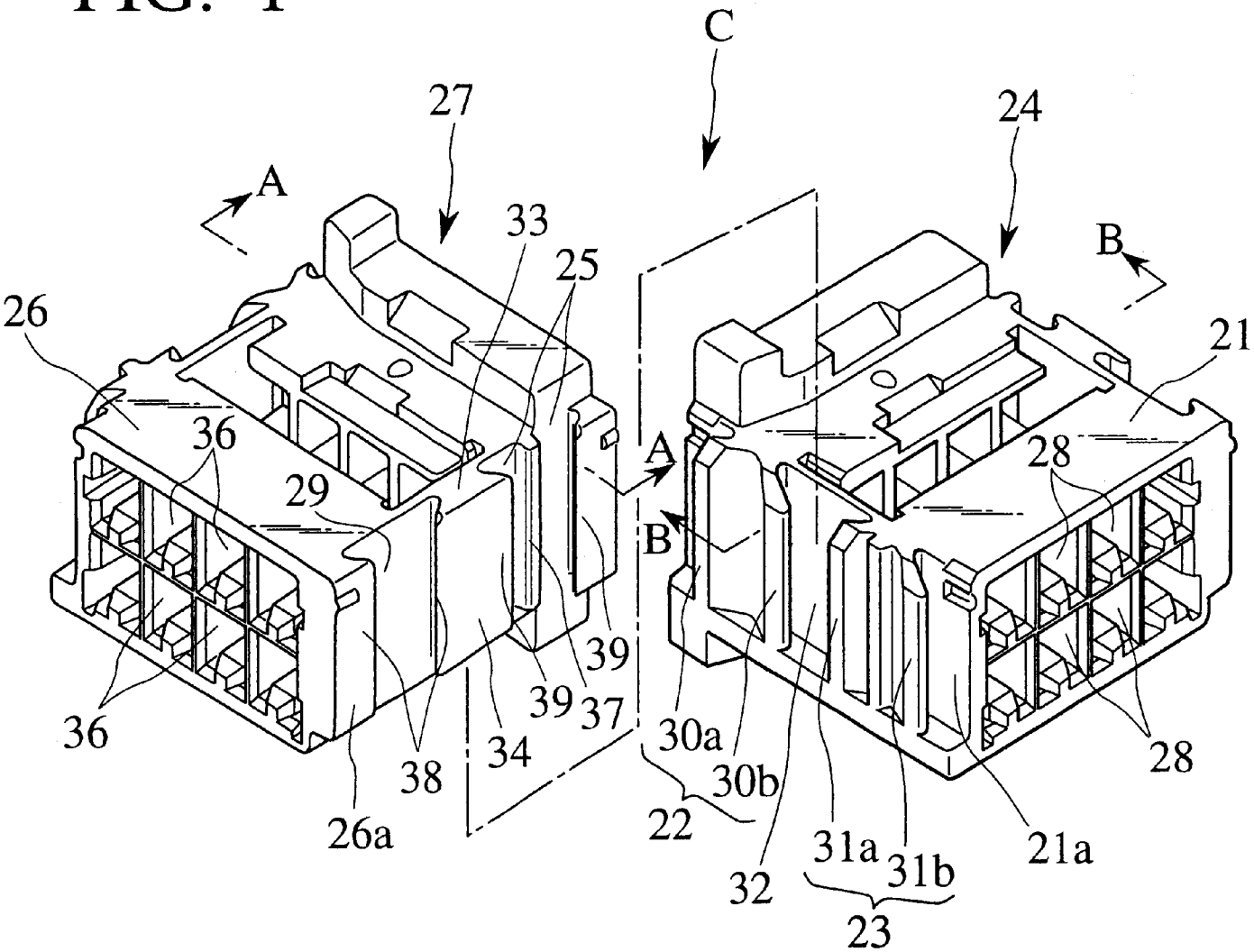
FIG. 1 is a perspective view showing both connectors before join in a joining connector system in accordance with an embodiment of the present invention.

The joining connector system C in accordance with the present embodiment is, as shown in FIG. 1, structured such that a first connector 24 corresponding to one connector having engaging pieces 22 and 23 protruded on an outer wall 21*a* of a connector housing 21, and a second connector 27 corresponding to another connector having engaging grooves 25 and 29 to which the engaging pieces 22 and 23 are fitted being provided on an outer wall 26*a* of a connector housing 26 are joined by sliding the engaging pieces 22 and 23 along the engaging grooves 25 and 29.

More particularly, the first connector 24 has, as shown in FIG. 1, the box-shaped connector housing 21 made of an insulating resin material.

A plurality of terminal receiving chambers 28 receiving terminals (not shown) to which electric wire ends of wire harnesses are connected are formed in the connector housing 21. In accordance with the resent embodiment, the terminal receiving chambers 28 are, for example, structured so as to be arranged in two stages in a vertical direction to form two lines and four rows.

Two engaging pieces 22 and 23 respectively fitted to two engaging grooves 25 and 29 formed in the second connector 27 are protruded on the outer wall 21*a* of the first connector 24 joined to the second connector 27.

Figure 3:
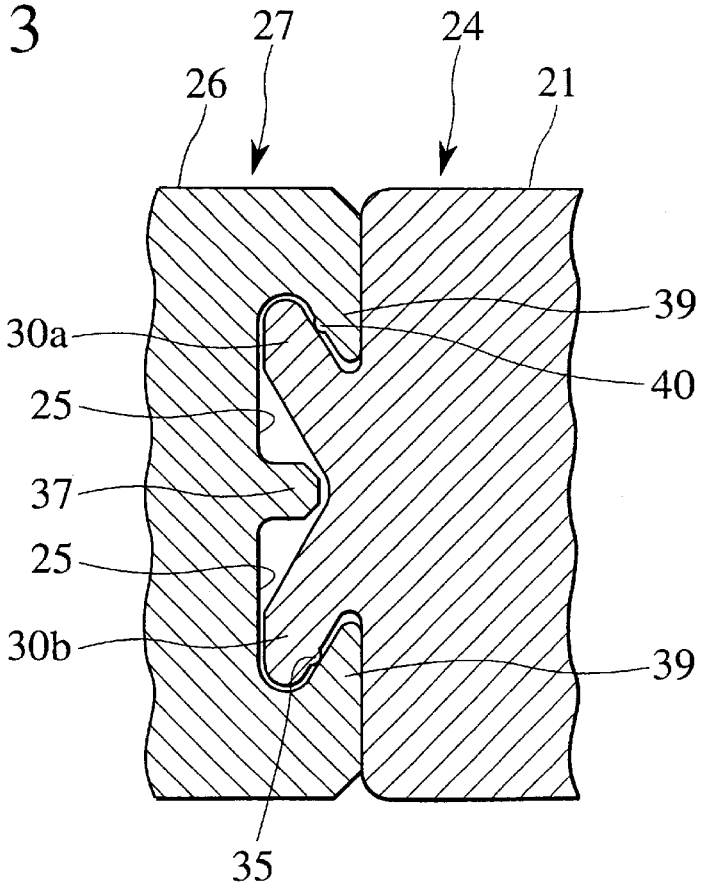
FIG. 3 is an enlarged cross sectional view of a main portion showing a state that an engaging piece is fitted to an engaging groove in the joining connector system in accordance with the present embodiment.
Figure 4:
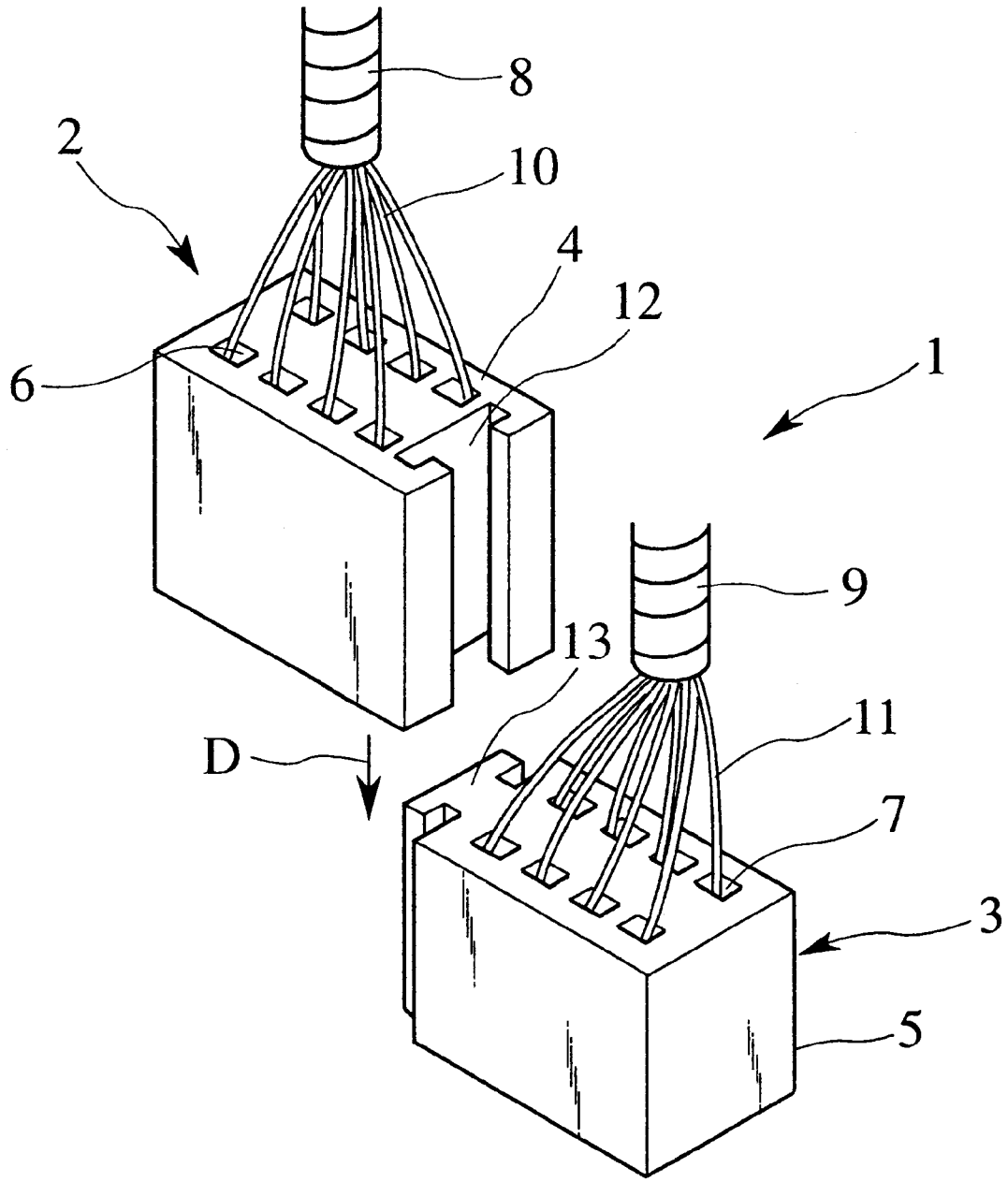
FIG. 4 is a perspective view of a joining connector system before engagement in accordance with a consideration of the inventors of the present application.
Figure 5:
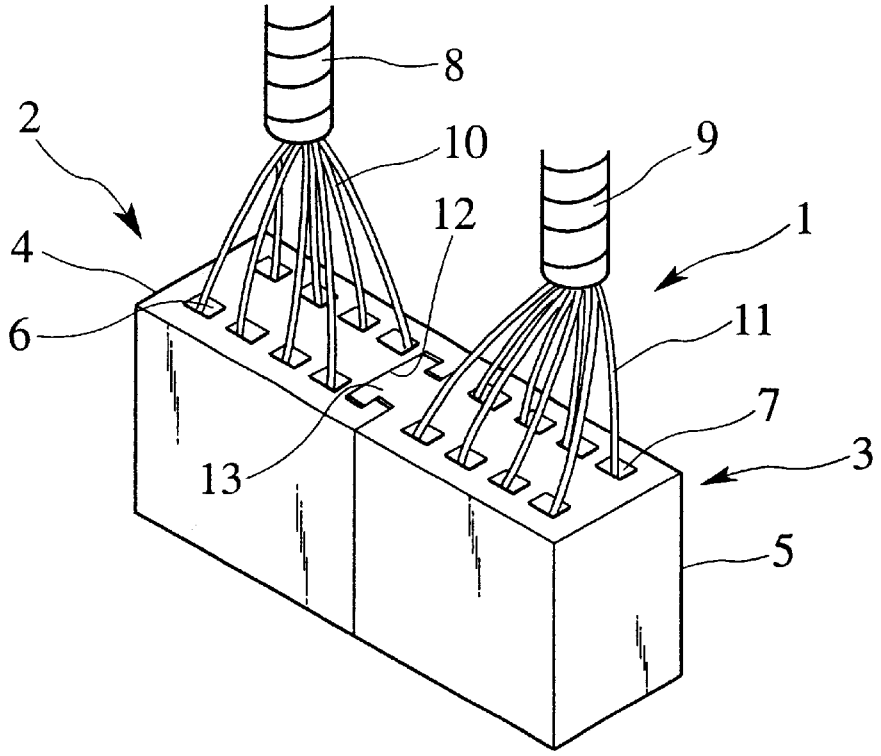
FIG. 5 is a perspective view of an engaging state of the joining connector system in accordance with a consideration of the inventors.
Figure 6:
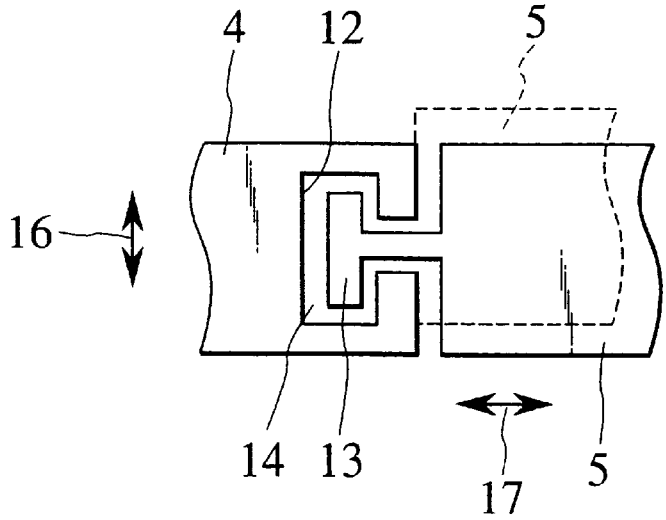
FIG. 6 is a plan view explaining considered points of the joining connector system in accordance with a consideration of the inventors.

The engaging pieces 22 and 23 have a pair of lips 30*a*, 30*b* and 31*a*, 31*b* formed in a V shape in a plan view, typically as shown in FIG. 3. These lips 30*a*, 30*b* and 31*a*, 31*b* are formed so as to vertically extend along a height direction of the connector housing 21 from the outer wall 21*a*, and free end portions thereof (front end portions with respect to the outer wall 21*a*) can be bent and changed within an elastic range.

A joining reference surface 32 to which the first connector 24 and the second connector 27 are closely attached when these connectors 24 and 27 are joined is provided between a pair of engaging pieces 22 and 23. Another joining reference surface 34 corresponding to a front end surface of a projection portion 33 protruding between a pair of engaging grooves 25 and 29 formed in the second connector 27 is closely attached to the joining reference surface 32 due to a surface contact.

Figure 2A:
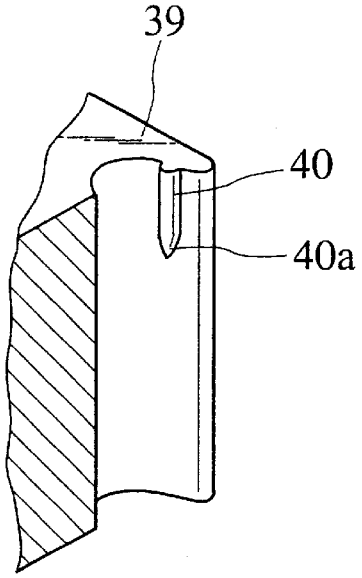
FIG. 2A is an enlarged cross sectional view taken along a line A—A of a main portion of one connector shown in FIG. 1
Figure 2B:
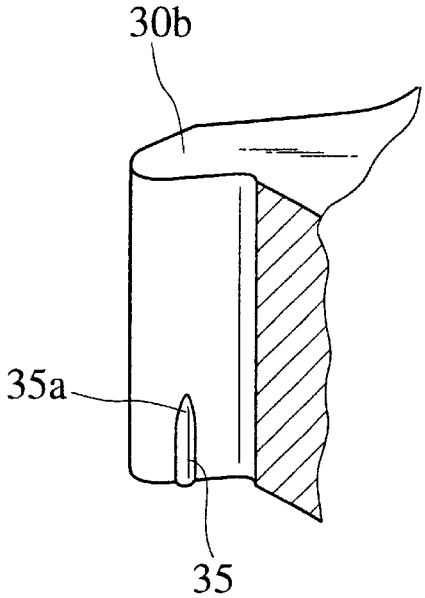
FIG. 2B is an enlarged cross sectional view taken along a line B—B of a main portion of another connector shown in FIG. 1.

Protrusions 35 for reducing an inserting force after a time when a joining slide is started and before the join is finished, and gradually increasing the inserting force immediately after the join is finished so as to close attach both of the connectors 24 and 27, when engaging and sliding the first connector 24 and the second connector 27 as shown in FIG. 2B is formed in a pair of lips 30*a*, 30*b* and 31*a*, 31*b*. The protrusion 35 formed in one lip 30*b* is only illustrated in FIG. 2B.

The protrusion 35 is formed as a projection tapered toward a joining slide direction of both of the connectors 24 and 27 (an upward direction of a height of the lip 30*b* in the case of the first connector 24), and is provided near a joining end between both connectors. In other words, the protrusion 35 mentioned above is provided in such a manner that a width of a front end portion 35*a* of the protrusion 35 is narrowed toward an upper portion from a base end portion of the lip 30*b* so as to extend in a height direction as a short continuous projection. For example, a length of the protrusion 35 is set to have a length equal to or less than one third of the height of the lip 30*b* mentioned above.

On the contrary, the second connector 27 also has box-shaped connector housing 26 made of an insulating resin material in the same manner as the first connector 24, as shown in FIG. 1, and is provided with a plurality of terminal receiving chambers 36 in the connector housing 26. Then, the engaging grooves 25 and 29 to which the respective engaging pieces 22 and 23 are fitted are provided on an outer wall 26*a* of the second connector 27.

These engaging grooves 25 and 29 are formed so as to form a groove continuing from an upper end to a lower end along the height direction of the second connector 27, and are structured such that the lips 30*a*, 30*b* and 31*a*, 31*b* of the engaging pieces 22 and 23 are inserted into the engaging grooves 25 and 29 so as to be fitted thereto by a slide operation. Surrounding portions 38 and 39 for covering the lips 30*a*, 30*b* and 31*a*, 31*b* are provided in both sides of the engaging grooves 25 and 29 in such a manner as to overhang with respect to the engaging grooves 25 and 29.

The surrounding portions 38 and 39 are brought into contact with the lips 30*a*, 30*b* and 31*a*, 31*b* inserted and slid to the engaging grooves 25 and 29 so as to function to prevent the lips 30*a*, 30*b* and 31*a*, 31*b* from falling out from the engaging grooves 25 and 29.

Further, a protrusion 40 having the same function as that of the protrusion 35 formed in the first connector 24 mentioned above is formed on inner wall surfaces of the surrounding portions 38 and 39. Only the protrusion 40 formed on the inner wall surface of one surrounding portion 39 is illustrated in FIG. 2A.

The protrusion 40 is, as shown in FIG. 2A, formed as a projection tapered toward a joining slide direction of both of the connectors 24 and 27 (a lower direction of a height of the surrounding portion 39), and is provided near a joining end between both connectors. In other words, the protrusion 40 is provided in such a manner that a width of a front end portion 40*a* of the protrusion 40 is narrowed toward a lower portion from an upper end portion of the surrounding portion 39 so as to extend in a height direction as a short continuous projection. For example, a length of the protrusion 40 is set to have a length equal to or less than one third of the height of the surrounding portion 39 mentioned above.

In this case, substantially in a center portion of one engaging groove 25, as shown in FIGS. 1 and 3, a projection portion 37 is formed between the lip portions 30*a* and 30*b* from an upper end to a lower end along the height direction of the second connector 27.

In order to assemble the first connector 24 and the second connector 27 structured in the manner mentioned above so as to finish the joining connector system C, the following operations are performed.

At first, the engaging pieces 22 and 23 of the first connector 24 and the engaging grooves 25 and 29 of the second connector 27 are respectively opposed to each other, both of the connectors 24 and 27 are arranged so that the protrusions 35 and 40 are not brought into contact with each other and are apart from each other, and the engaging pieces 22 and 23 are inserted to the engaging grooves 25 and 29 from a position that the protrusions 35 and 40 are apart from each other and slid.

Then, after an insertion of both the connectors 24 and 27 is started and immediately before the join is finished, the first connector 24 and the second connector 27 are being joined to each other due to a comparative weak insertion force.

When both of the connectors 24 and 27 becomes immediately before the completion of the join, that is, the protrusions 35 and 40 provided in the lips 30*a*, 30*b*, 31*a* and 31*b* and the engaging grooves 25 and 29 start being brought into contact with the respective corresponding lips 30*a*, 30*b*, 31*a* and 31*b* or the engaging grooves 25 and 29, the lips 30*a*, 30*b*, 31*a* and 31*b* is bent within an elastic range, and both of the connectors 24 and 27 are aligned with each other.

At this time, since the front ends of the protrusions 35 and 40 are tapered toward the joining slide direction, a combination insertion force is gradually increased.

As a result, the joining reference surface 32 of the first connector 24 and the joining reference surface 34 of the second connector 27 are surface contact so as to be closely attached.

When the join between the first connector 24 and the second connector 27 is finished, both of the connectors 24 and 27 are closely attached to each other due to an operation of the protrusions 35 and 40 by an elastic force generated by an elastic displacement of the lips 30*a*, 30*b*, 31*a* and 31*b*, thereby being joined without generating a positional shift.

Therefore, in accordance with the joining connector system C mentioned above, since the protrusions 35 and 40 are not in contact with the lips 30*a*, 30*b* , 31*a* and 31*b* or the engaging grooves 25 and 29 after the join between both of the connectors 24 and 27 is started immediately before the join is finished, a small combination insertion force is sufficient, and since the protrusions 35 and 40 start being in contact with the lips 30*a*, 30*b*, 31*a* and 31*b* or the engaging grooves 25 and 29 immediately after the join, the combination insertion force is increased.

As mentioned above, since the small combination insertion force is sufficient immediately before the join is finished and the combination insertion force is gradually increased immediately after the join, it is possible to make an assembling operability of both of the connectors 24 and 27 easy and it is possible to widely improve a productivity. Further, it is possible to effectively prevent a pitch shift between both of the connectors by removing a play between the joined connector housings.

In this case, a description is given of the particular present embodiment to which the present invention is applied, as mentioned above, however, the present invention is not limited to the embodiments mentioned above and various modifications of the present invention can be obtained.

For example, in the present embodiment, the protrusions 35 and 40 are provided in both of the lips 30*a*, 30*b*, 31*a* and 31*b* and the engaging grooves 25 and 29, however, the same effects can be obtained if the protrusions 35 and 40 are provided in any one of the lips 30*a*, 30*b*, 31*a* and 31*b* and the engaging grooves 25 and 29.

Further, the protrusion 35 may be provided only in the lips 30*a*, 30*b*, 31*a* and 31*b* and the protrusion 40 may be provided only in the engaging grooves 25 and 29 in the same manner.

In addition, the present invention can be realized by variously modifying the present invention within the technical scope of the present invention.

What is claimed is:

1. A joining connector system, comprising:

a first connector, including a connector housing and an engaging piece disposed on the housing;

a second connector, including a connector housing and an engaging groove disposed on the housing for receiving the engaging piece, wherein the engaging piece is received by the engaging groove by sliding the engaging piece in the engaging groove in a sliding direction; and a protrusion disposed on at least one of the engaging piece and the engaging groove wherein the protrusion is tapered in the sliding direction such that as the engaging piece moves relative to the engaging groove in the sliding direction, contact between the protrusion and the other of the engaging piece and the engaging groove elastically deforms the engaging piece and creates an elastic force to attach the first connector to the second connector.

2. A joining connector system as claimed in claim 1, wherein the second connector further comprises:

a plurality of engaging grooves disposed on the housing; and a reference surface disposed on the housing between the plurality of engaging grooves for positioning the first connector.

3. A joining connector system as claimed in claim 1, wherein the first connector further comprises:

a plurality of engaging pieces disposed on the housing; and a reference surface disposed on the housing between the plurality of engaging pieces for positioning the second connector.

4. A joining connector system as claimed in claim 1, wherein a protrusion is disposed on both of the engaged pieces and the engaging groove.

5. A joining connector system as claimed in claim 4, wherein the protrusion has a length equal to or less than one third of a length of the respective engaging piece or engaging groove on which it is disposed.

6. A joining connector system as claimed in claim 1, wherein the engaging groove has an overhanging groove portion and the engaging piece has a lip portion corresponding to the overhanging groove portion.

7. A joining connector system as claimed in claim 6, wherein the protrusion is disposed on at least one of the lip portion and the overhanging groove portion.

8. A joining connector system as claimed in claim 6, wherein the lip piece of the engaging portion has a pair of lips.

9. A joining connector system as claimed in claim 8, wherein the engaging groove correspondingly has a protruding portion between the pair of lips in the lip portion of the engaging piece.

* * * * *

UNITED STATES PATENT AND TRADEMARK OFFICE

CERTIFICATE OF CORRECTION

PATENT NO. : 6,375,517 B1 
DATED : April 23, 2002
INVENTOR(S) : Toshiaki Okabe et al.

It is certified that error appears in the above-identified patent and that said Letters Patent is hereby corrected as shown below:

Column 5,
Line 44, “groove wherein” should read -- groove, wherein --.

Column 6,
Line 25, “engaged pieces and” should read -- engaging piece and --.
Line 27, “the protrusion” should read -- each protrusion --.

Signed and Sealed this

Eighth Day of October, 2002

*Attest:*

*Attesting Officer*

JAMES E. ROGAN
*Director of the United States Patent and Trademark Office*